US006991390B2

(12) United States Patent
Sabato

(10) Patent No.: US 6,991,390 B2
(45) **Date of Patent: *Jan. 31, 2006**

(54) LOCATING KEY FOR A KEYBOARD OR KEYPAD

(76) Inventor: Alberto B. Sabato, 21 Clanalpine Street, Mosman, NSW 2088 (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/236,859

(22) Filed: Sep. 6, 2002

(65) Prior Publication Data

US 2003/0068183 A1 Apr. 10, 2003

Related U.S. Application Data

(63) Continuation of application No. 09/913,105, filed as application No. PCT/AU00/00691 on Jun. 21, 2000, now Pat. No. 6,752,552.

(30) Foreign Application Priority Data

| | | |
|---|---|---|
| Jun. 21, 1999 | (AU) | PQ1115 |
| Dec. 8, 1999 | (AU) | PQ4525 |
| Sep. 11, 2001 | (AU) | PR7613 |

(51) Int. Cl.
*B41J 5/12* (2006.01)

(52) U.S. Cl. ..... 400/490; 400/472

(58) Field of Classification Search ..... 400/490, 400/494, 483, 472; 341/21, 22; 361/680; 364/709.12; 235/145 R, 146; 200/5 R, 200/52 R; 345/168, 169

See application file for complete search history.

(56) References Cited

U.S. PATENT DOCUMENTS

| | | | | |
|---|---|---|---|---|
| 1,041,696 | A | 10/1912 | Summerville | 400/494 |
| 1,718,694 | A | 6/1929 | Kurowski | 400/483 |
| 1,823,130 | A | 9/1931 | Smith | 400/483 |
| 2,350,059 | A | 5/1944 | Messchaert | 197/101 |
| 3,396,827 | A | 8/1968 | Harwell | 197/98 |
| 3,848,723 | A | 11/1974 | Hogue | 197/102 |
| 4,180,336 | A | 12/1979 | Lonsdale | 400/491.3 |
| 4,762,436 | A | 8/1988 | Herzog et al. | 400/491.3 |
| 4,778,295 | A | 10/1988 | Bleuer | |
| 4,994,992 | A | 2/1991 | Lapeyre | 364/709.15 |
| 5,515,763 | A | 5/1996 | Vandervoort | 84/433 |
| 5,583,497 | A | 12/1996 | Hankes | 341/22 |
| 5,610,602 | A | 3/1997 | Hargreaves | 341/22 |
| 5,689,253 | A | 11/1997 | Hargreaves et al. | 341/22 |
| 6,005,496 | A | 12/1999 | Hargreaves et al. | 341/22 |
| 6,667,697 | B2 * | 12/2003 | Botich | 341/22 |

FOREIGN PATENT DOCUMENTS

| | | |
|---|---|---|
| GB | 2087313 | 5/1982 |
| GB | 2134042 | 8/1984 |
| WO | 8102272 | 8/1981 |

* cited by examiner

*Primary Examiner*—Anthony Nguyen
(74) *Attorney, Agent, or Firm*—Ladas & Parry LLP

(57) ABSTRACT

A key (21) for a keyboard or keypad, the key (21) having an upper finger engaged surface (2) defining a generally top edge portion (3) remote from the user, a generally bottom edge portion (4) adjacent to the user, a generally left edge portion (5) and a generally right edge portion (6), the key (21) further having a ridge (22) adjacent to the top edge portion (3), the bottom edge portion (4), the left edge portion (5) and/or the right edge portion (6).

10 Claims, 11 Drawing Sheets

LOCATING KEY FOR A KEYBOARD OR KEYPAD

This is a continuation of application Ser. No. 09/913,105 filed Nov. 20, 2001 which is now U.S. Pat. No. 6,752,552 which is a 371 of PCT/AU00/00691 Jun. 21, 2000.

FIELD OF THE INVENTION

The present invention relates to keys on a keyboard or keypad. More particularly, though not exclusively, the invention relates to locating keys for a computer or electronic keyboard or keypad which improves keyboard/keypad operating skills.

BACKGROUND OF THE INVENTION

A substantial number of modern electronic devices and even older equipment such as electric typewriters are equipped with a keyboard or keypad of some sort for manually inputting commands into the devices. The most common form of keyboard is that of the computer keyboard and the most common form of keypad is that of a telephone.

Referring to the computer keyboard, the most widely recommended method of input using one of the common keyboards is the "touch typing" method. This method simply trains a user to memorise the keyboard layout so thoroughly that he/she may type using all the fingers without looking at the keyboard. This method is achieved by constant practice and assigning each finger to a particular group of keys.

In particular, the "touch typing" method places each respective finger lightly on a "home" key, for example, in the "QWERTY" keyboard these home keys are "asdf" and "jkl;" from left to right. The thumbs are then placed over the space bar. Each finger rests lightly on its home key and does not move unless it reaches to strike keys immediately above or below the home key or in the case of each of the index fingers, the keys immediately to the side of the home key, then the finger quickly returns to its home key. Thus, each finger has only certain keys that it should strike.

Untrained keyboard operators use what is called the "hunt and peck" system. Usually they use only their two forefingers or at most their four best fingers, the forefingers and middle fingers while looking at the keyboard. This method requires that the typist keeps the eyes on the keyboard and this affects productivity. Although some of these typists can type about as fast as touch typists, very fast hunt and peck typing is more tiring than touch typing because the hands have to leap all around the keyboard to reach all the keys with only two or four fingers. In summary, to "keyboard" correctly, typists must use the touch typing method described above so they are not looking at the keyboard. Similar problems arise in the use of keypads and in particular with mobile phones if the user needs to look at the keypad while trying to drive, or if the user is blind for example.

In an attempt to overcome the shortcomings of some of the prior art, many alternate shaped keyboards have been developed. One such keyboard is the KINESIS keyboard (for example, U.S. Pat. No. 6,005,496 to Hargreaves, et al) which describes a keyboard having two wells for the receipt of the right and left hands of a user. The advantage of such a keyboard is that the location of the wells allows a user's arms to extend straight out in front of the user thereby reducing the need for the user to move his or her hands along the keyboard. However, these types of keyboards are complicated to operate and rely on the user to memorise key combinations and macros.

Many other patterns such as U.S. Pat. Nos. 1,823,130; 3,396,827; 3,848,723; 5,515,763 and 4,180,336, for example, describe keys for keyboards having top surfaces including longitudinal ridges, slots, rows of ridges, knobs, craters and texturing. Various combinations of texturing are also known.

Therefore, there is a need in the art for a keyboard and keypad that "forces" a typist to type correctly, reducing typing inaccuracies, minimising strain and effort and allowing a user to not look at the keyboard or keypad when operating the device. The applicant's earlier application PCT/AU00/00691 was directed towards achieving similar outcomes.

OBJECT OF THE INVENTION

It is an object of the present invention to overcome or ameliorate some of the disadvantages of the prior art, or at least to provide a useful alternative.

SUMMARY OF THE INVENTION

There is disclosed herein a key for a keyboard or keypad, said key having an upper finger engaged surface of generally square or rectangular configuration so as to have a top edge portion remote from a user, a bottom edge portion adjacent to the user, a left edge portion and a right edge portion, said key further having:

a ridge adjacent to said top edge portion or to said bottom edge portion and extending longitudinally generally parallel thereto; and a ridge on said left or said right edge portion.

There is further disclosed herein a keyboard or keypad including at least three rows of keys including a top row which is remote from a user, a middle row, and a bottom row which is adjacent to the user, each row having at least three keys including a left and a right end key, each key having an upper finger engaged surface of generally square or rectangular configuration so as to have top and bottom edge portions extending generally parallel to the rows, and left and right edge portions extending generally normal to the rows, and wherein the keys include:

(i) a ridge on the top left end key adjacent to the upper edge portion thereof extending generally parallel to the rows, (ii) a ridge on the top left end key adjacent to the left edge portion thereof extending generally normal to the rows, (iii) a ridge on the bottom left end key adjacent to the left edge portion thereof extending generally normal to the rows, (iv) a ridge on the bottom left end key adjacent to the bottom edge portion thereof extending generally parallel to the rows, (v) a ridge on the bottom right end key adjacent to the bottom edge portion thereof extending generally parallel to the rows, (vi) a ridge on the bottom right end key adjacent to the right edge portion thereof extending generally normal to the rows, (vii) a ridge on the top end key adjacent to the right edge portion thereof extending generally normal to the rows, and (viii) a ridge on the top right end key adjacent to the upper edge portion thereof extending generally parallel to the rows.

There is further disclosed herein a QWERTY keyboard having a plurality of alphanumeric keys arranged in three linear rows including a top row which is remote from a user, a middle row, and a bottom row which is adjacent the user, each row having a left and a right end key, each key having an upper finger engaged surface of generally square or rectangular configuration so as to have top and bottom edge portions extending generally parallel to the rows, and left and right side edge portions extending generally normal to the rows, the keys being positioned in a left first set and a right second set, the first set including the three left end keys and at least the next two or three adjacent keys of each row, the second set including the three right end keys and the next adjacent two or three keys spaced toward the first set so that the two sets are spaced by two, three or four keys, and wherein the keys of said first set include:

(i) a ridge on the top left end key adjacent to the upper edge portion thereof extending generally parallel to the rows, (ii) a ridge on the top left end key adjacent to the left edge portion thereof extending generally normal to the rows, (iii) a ridge on the middle left end key adjacent to the left edge portion thereof extending generally normal to the rows, (iv) a ridge on the bottom left end key adjacent to the left edge portion thereof extending generally normal to the rows, (v) a ridge on the bottom left end key adjacent to the bottom edge portion thereof extending generally parallel to the rows, (vi) a ridge on the next adjacent or next two adjacent keys to said bottom left end key of the bottom row adjacent to the bottom edge portion thereof extending generally parallel to the rows, (vii) a ridge on the next adjacent bottom key adjacent to the bottom edge portion thereof extending generally parallel to the rows, (viii) a ridge on said last mentioned key adjacent to the right edge portion thereof extending generally normal to the rows, (ix) a ridge on the middle key next adjacent to said last mentioned key adjacent to the right edge portion thereof extending generally normal to the rows, (x) a ridge on the top key next adjacent to said last mentioned key adjacent to the right edge portion thereof extending generally normal to the rows, (xi) a ridge on said last mentioned key adjacent to the top edge portion thereof extending generally parallel to the rows, (xii) a ridge on the or each top key between said last mentioned key and said top left end key adjacent to the top edge portion thereof extending generally parallel to the rows, and the keys of said second set include:

(i) a ridge on the top right end key adjacent to the upper edge portion thereof extending generally parallel to the rows, (ii) a ridge on the top right end key adjacent to the right edge portion thereof extending generally normal to the rows, (iii) a ridge on the middle key adjacent to said top right key adjacent to the right edge portion thereof extending generally normal to the rows, (iv) a ridge on the bottom right end key adjacent to the right edge portion thereof extending generally normal to the rows, (v) a ridge on the bottom right end key adjacent to the bottom edge portion thereof extending generally parallel to the rows, (vi) a ridge on the next adjacent or next two adjacent keys to said bottom right end key of the bottom row adjacent to the bottom edge portion thereof extending generally parallel to the rows, (vii) a ridge on the next adjacent bottom key adjacent to the bottom edge portion thereof extending generally parallel to the rows, (viii) a ridge on said last mentioned key adjacent to the left edge portion thereof extending generally normal to the rows, (ix) a ridge on the middle key next adjacent to said last mentioned key adjacent to the left edge portion thereof extending generally normal to the rows, (x) a ridge on the top key next adjacent to said last mentioned key adjacent to the left edge portion thereof extending generally normal to the rows, (xi) a ridge on said last mentioned key adjacent to the top edge portion thereof extending generally parallel to the rows, (xii) a ridge on the or each top key between said last mentioned key and said top right end key adjacent to the top edge portion thereof extending generally parallel to the rows.

There is further disclosed herein a key for a keyboard or keypad, said key having an upper finger engaged surface defining a generally top edge portion remote from the user, a generally bottom edge portion adjacent to the user, a generally left edge portion and a generally right edge portion, said key further having:

a ridge adjacent to either said top edge portion or said bottom edge portion, and a ridge adjacent to either said left edge portion or said right edge portion.

There is further disclosed herein a keyboard or keypad including at least three rows of keys including a top row which is remote from the user, a middle row, and a bottom row which is adjacent to the user, each row having at least three keys including a left and a right end key, each key having an upper finger engaged surface of generally square, round, oval or rectangular configuration so as to have top and bottom edge portions extending generally parallel to the rows, and left and right edge portions extending generally normal to the rows, and wherein the keys include:

(i) a ridge on the top left end key adjacent to the upper edge portion thereof extending generally parallel to the rows, (ii) a ridge on the top left end key adjacent to the left edge portion thereof extending generally normal to the rows, (iii) a ridge on the bottom left end key adjacent to the left edge portion thereof extending generally normal to the rows, (iv) a ridge on the bottom left end key adjacent to the bottom edge portion thereof extending generally parallel to the rows, (v) a ridge on the bottom right end key adjacent to the bottom edge portion thereof extending generally parallel to the rows, (vi) a ridge on the bottom right end key adjacent to the right edge portion thereof extending generally normal to the rows, (vii) a ridge on the top right end key adjacent to the right edge portion thereof extending generally normal to the rows, and (viii) a ridge on the top right end key adjacent to the upper edge portion thereof extending generally parallel to the rows.

There is further disclosed herein a QWERTY keyboard having a plurality of alphanumeric keys arranged in three linear rows including a top row which is remote from the user, a middle row, and a bottom row which is adjacent to the user, each row having a left and a right end key, each key having an upper finger engaged surface of generally square, round or rectangular configuration so as to have top and bottom edge portions extending generally parallel to the rows, and left and right side edge portions extending generally normal to the rows, the keys being positioned in a left first set and a right second set, the first set including the three left end keys and at least the next two or three adjacent keys of each row, the second set including the three right end keys and the next adjacent two or three keys spaced toward the first set so that the two sets are spaced by two, three or four keys, and wherein the keys of said first set include:

(i) a ridge on the top left end key adjacent to the upper edge portion thereof extending generally parallel to the rows, (ii) a ridge on the top left end key adjacent to the left edge portion thereof extending generally normal to the rows, (ii) a ridge on the middle left end key adjacent to the left edge portion thereof extending generally normal to the rows, (iv) a ridge on the bottom left end key adjacent to the left edge portion thereof extending generally normal to the rows, (v) a ridge on the bottom left end key adjacent to the bottom edge portion thereof extending generally parallel to the rows, (vi) a ridge on the next adjacent or next two adjacent keys to said bottom left end key of the bottom row adjacent to the bottom edge portion thereof extending generally parallel to the rows, (vii) a ridge on the next adjacent bottom key adjacent to the bottom edge portion thereof extending generally parallel to the rows, (viii) a ridge on said last mentioned key adjacent to the right edge portion thereof extending generally normal to the rows, (ix) a ridge on the middle key next adjacent to said last mentioned key adjacent to the right edge portion thereof extending generally normal to the rows, (x) a ridge on the top key next adjacent to said last mentioned key adjacent to the right edge portion thereof extending generally normal to the rows, (xi) a ridge on said last mentioned key adjacent to the top edge portion thereof extending generally parallel to the rows, (xii) a ridge on the or each top key between said last mentioned key and said top left end key adjacent to the top edge portion thereof extending generally parallel to the rows, and the keys of said second set include:

(i) a ridge on the top right end key adjacent to the upper edge portion thereof extending generally parallel to the rows, (ii) a ridge on the top right end key adjacent to the right edge portion thereof extending generally normal to the rows, (iii) a ridge on the middle key adjacent to said top right key adjacent to the right edge portion thereof extending generally normal to the rows, (iv) a ridge on the bottom right end key adjacent to the right edge portion thereof extending generally normal to the rows, (v) a ridge on the bottom right end key adjacent to the bottom edge portion thereof extending generally parallel to the rows, (vi) a ridge on the next adjacent or next two adjacent keys to said bottom right end key of the bottom row adjacent to the bottom edge portion thereof extending generally parallel to the rows, (vii) a ridge on the next adjacent bottom key adjacent to the bottom edge portion thereof extending generally parallel to the rows, (viii) a ridge on said last mentioned key adjacent to the left edge portion thereof extending generally normal to the rows, (ix) a ridge on the middle key next adjacent to said last mentioned key adjacent to the left edge portion thereof extending generally normal to the rows, (x) a ridge on the top key next adjacent to said last mentioned key adjacent to the left edge portion thereof extending generally normal to the rows, (xi) a ridge on said last mentioned key adjacent to the top edge portion thereof extending generally parallel to the rows, (xii) a ridge on the or each top key between said last mentioned key and said top right end key adjacent to the top edge portion thereof extending generally parallel to the rows.

BRIEF DESCRIPTION OF THE DRAWINGS

A preferred form of the present invention will now be described by way of example with reference to the accompanying drawings, wherein.

DESCRIPTION OF AN EMBODIMENT OF THE PREFERRED INVENTION

Figure 1:
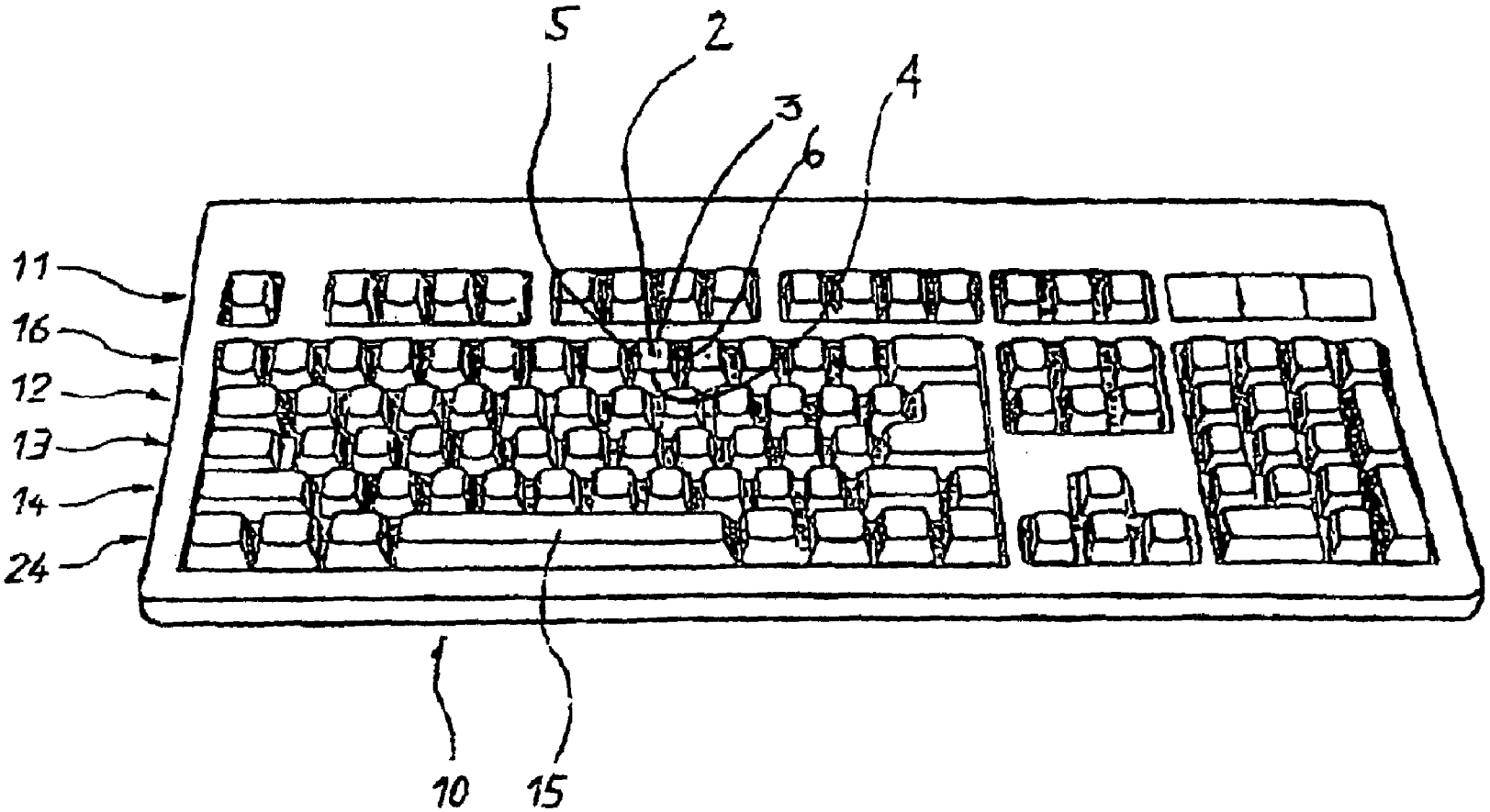
FIG. 1 is a perspective view of a typical standard QWERTY keyboard.

The improved keyboard is the result of specific modifications to an original standard keyboard 10 illustrated in FIG. 1. For clarity, the generally accepted geometrical design of a standard keyboard will first be described in order to provide a foundation for understanding the geometry of an improved keyboard. However, while the modifications of the present invention are most likely to be applied to a standard keyboard, it must be noted that these same modifications may be applied to many other keyboard designs or incorporated into the initial design of new keyboards or keypads.

The keys of the standard keyboard 10 are generally identical in shape and size, except for the outer function and modifier keys which are usually horizontally elongated in order to give the complete standard keyboard a generally rectangular appearance. However, the keys could be any shape or size. A normal key includes an upper finger engaging surface 2 of a generally square, round or rectangular configuration having a top edge portion 3 remote from a user, a bottom edge portion 4 adjacent to a user, a left edge portion 5 and a right edge portion 6.

The standard keyboard generally consists of a main alphanumeric body of at least three, but usually five, parallel, horizontal rows of keys (FIG. 1). However, a keyboard could have less or more rows or could be in a variety of configurations. In this example, at least three rows could consist of a top row remote from a user, a middle row and a bottom row adjacent to a user, the rows generally consisting of a series of alphanumeric keys followed by a series of function keys. For example, in FIG. 1, each of the three middle rows 12, 13, 14 includes a sequence of alphabetical and grammatical characters (such as the QWERTY or Dvorak sequence or the AZERTY or QWERTZ sequence, or any other sequence or different characters such as Korean or Japanese or other characters), bordered on the end of each row by modifier or function keys of some sort. That is, row 12 remote from the user has its alphanumeric keys starting with Q on the far left edge and finishing with ] on the far right edge. Row 13 is an intermediate row and has its alphanumeric keys starting with A on the far left edge and finishing with/on the far right edge. Similarly, row 14 being adjacent to a user has its alphanumeric keys starting with Z on the far left edge and finishing with/on the far right.

The lowest row of keys 24, positioned closest to the typist (i.e., adjacent to the user) and immediately under the lower of the middle three main rows 14, is generally made up of modifier or function keys on either end of a long space bar 15. The second highest row of keys 16, positioned above the upper of the middle three main rows 12, is generally made up mainly of numerical keys. The highest row 11 (remote from the user) is normally made up of function keys.

While the horizontal rows 16, 12, 13, 14, 24 of the standard keyboard are usually aligned without deviation, the vertical alignment of the keys is usually staggered, and it is this specific juxtaposition of horizontal and vertical key relationships which make up the geometry of the standard keyboard 10 (FIG. 1). In particular, the reference for the vertical alignment shift is generally the home row, or middle row 13. The row 14 immediately beneath the home row, generally the lower alphabetical row, is usually organised in such a way that the keys of this row have their midpoints oriented in vertical alignment with or near the space between the keys of the home row 13. The row 12 immediately above the home row 13, generally the upper alphabetical row, is usually organised in such a way that the keys of this row have their midpoints oriented in vertical alignment with or near the left one-third vertical divider of the keys of the home row 13. Finally, the row 16 immediately above the upper alphabetical row 12, which is the row above the home row 13, is usually organised in such a way that the keys of this row 16 have their midpoints oriented in vertical alignment with or near the space between the keys of the row 12 immediately beneath them.

This general key relationship is the essence of what is usually referred to as the standard keyboard geometry (FIG. 1). While the specific organisation of the alphanumeric characters assigned to the keys of such a keyboard may vary, this will normally not affect the geometrical description of the keyboard 10, or the applicability to the modifications suggested herein.

Figure 3:
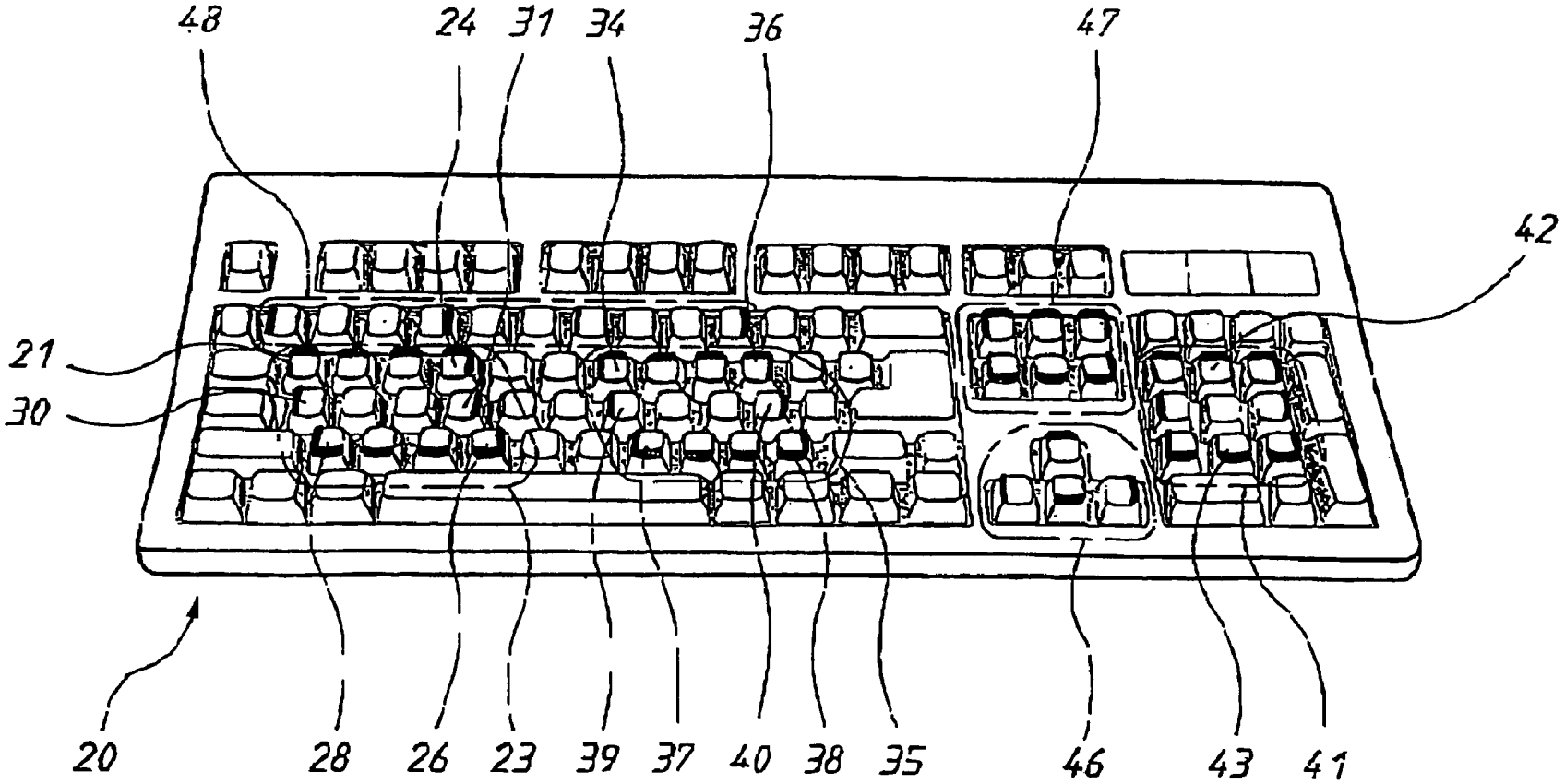
FIG. 3 is a perspective view of an improved QWERTY keyboard made in accordance with the present invention.

The foundation of the improved keyboard 20 the subject of at least a preferred embodiment of this invention, one variation of which is shown in FIG. 3, is the idea of providing certain keys with the means of generating a specific feedback, such that a user operating the device will not need to look at the keyboard or keypad. The feedback differs according to the position of the key and is such that the feedback of certain keys together, creates a virtual "box" within which the fingers can travel. In other words, the keys are so modified that a "wall" is created, which wall the fingers sense and within which wall they are guided (and almost forced) to operate. Therefore, not only the specific design of the keys gives a user the exact feel for where the finger is, but also the keys are so modified that they almost "force" the user to stay within the "walls" that the modifications have created.

This in turn facilitates (and almost forces) the use of specific fingers on specific keys and eventually makes a user proficient in the use of the keyboard or keypad without looking.

Figure 4:
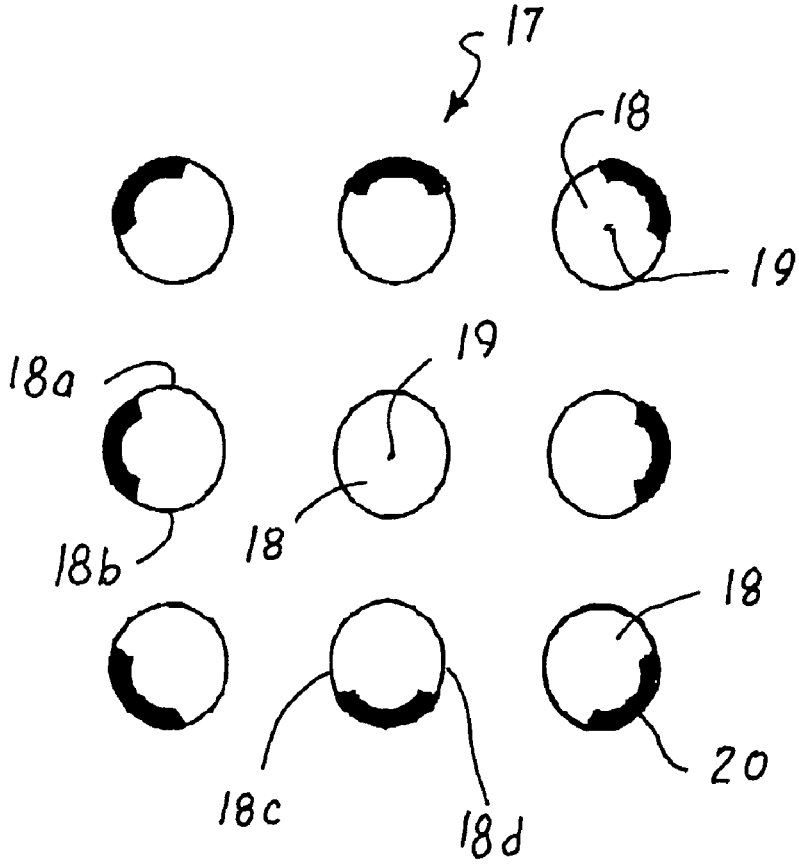
FIG. 4 is a plan view of rounded keys and rounded edges for use with the present invention.

In FIG. 4 is shown a plan view of rounded keys 17 with rounded edges for use with the present invention. In this embodiment each key 17 includes a finger engaged surface 18 with a central axis 19 perpendicular to the surface 18. In FIG. 4 the axis 19 runs normal to the page. The surface 18 has arcuate top and bottom edge portions 18*a, b* extending angularly about axis 19 and arcuate left and right edge portions 18*c, d* also extending angularly about the axis 19. The keys 17 which surround a central key include a ridge 20 on one edge portion as shown. These keys are typically used on telephones, calculators, electrical appliances and other such devices.

Figure 2A:
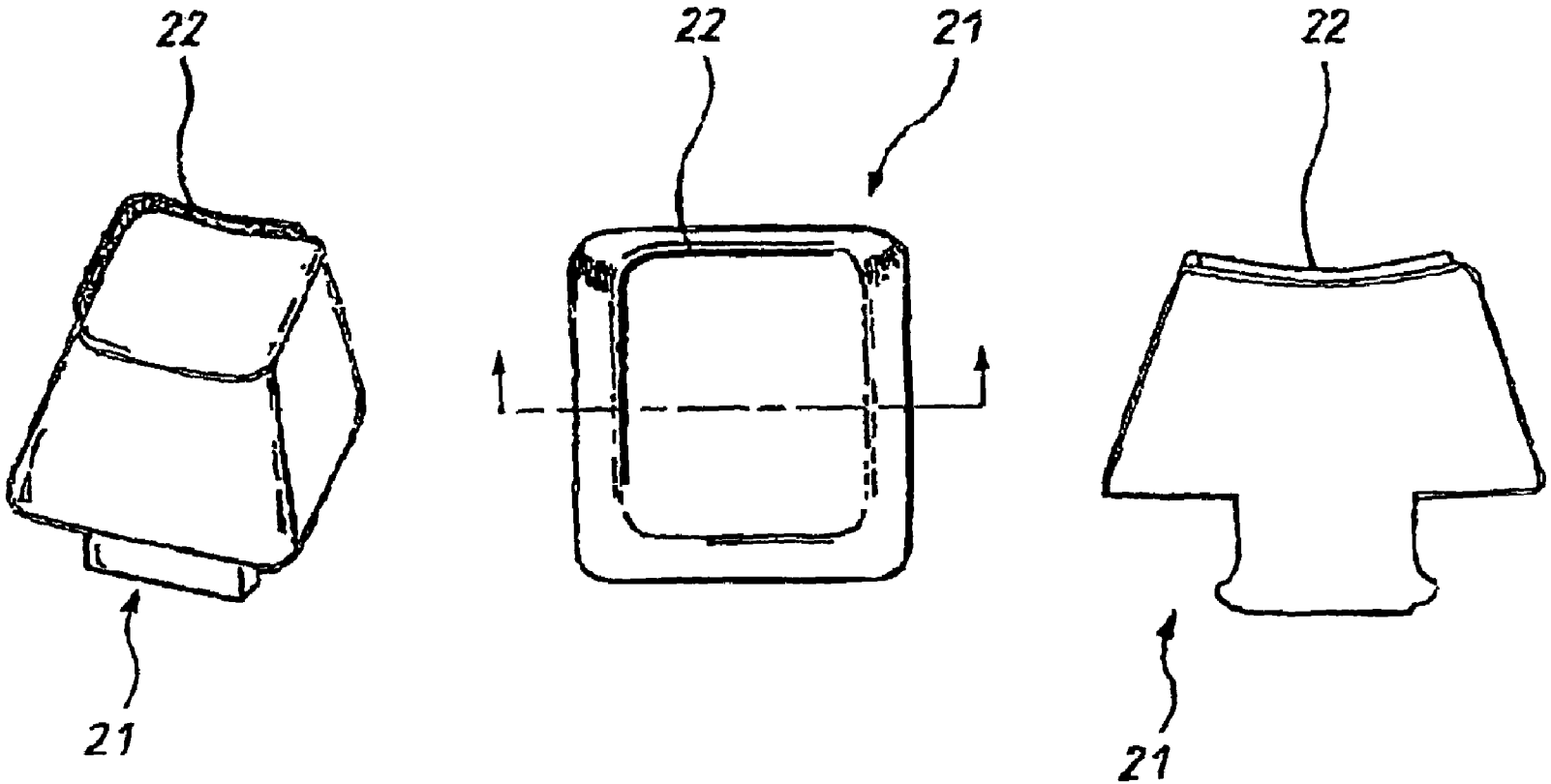
FIGS. 2A through 2H are schematic diagrams showing how certain keys of the QWERTY keyboard are modified in order to provide a positive feedback according to the present invention.
Figure 2B:
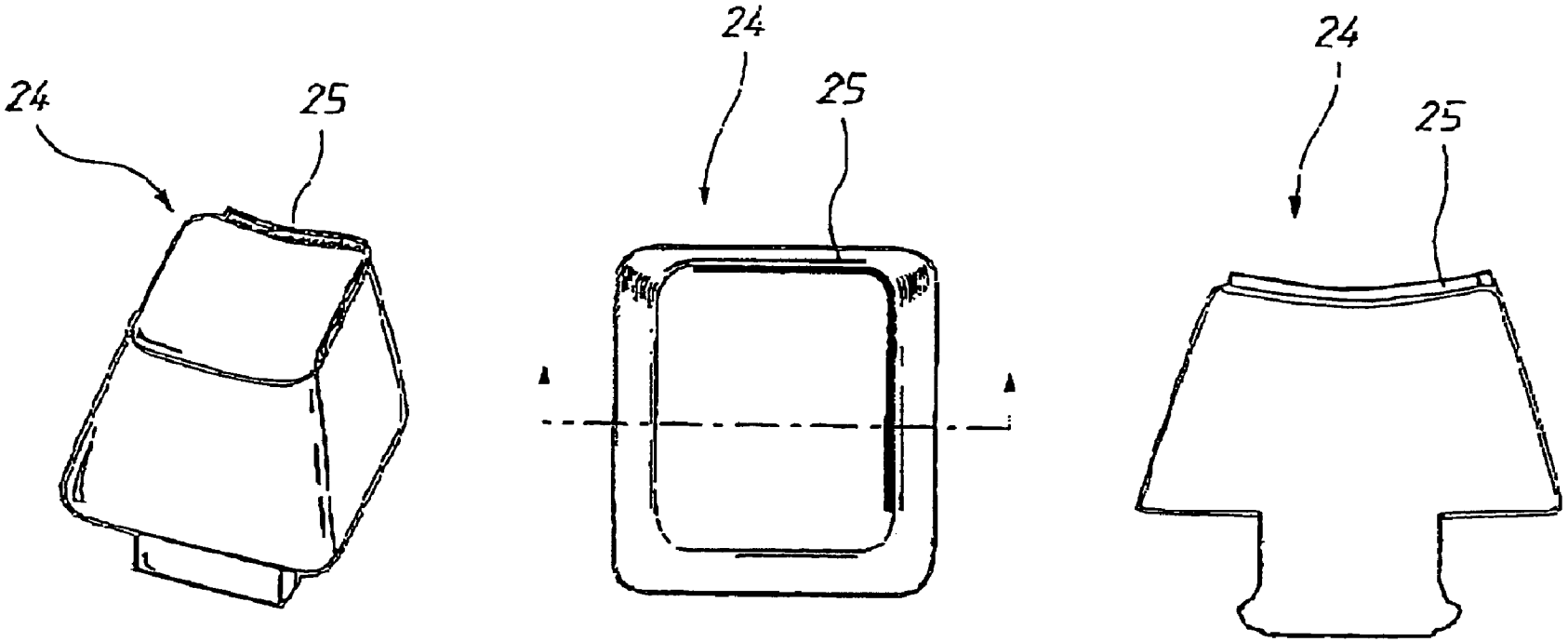
Figure 2C:
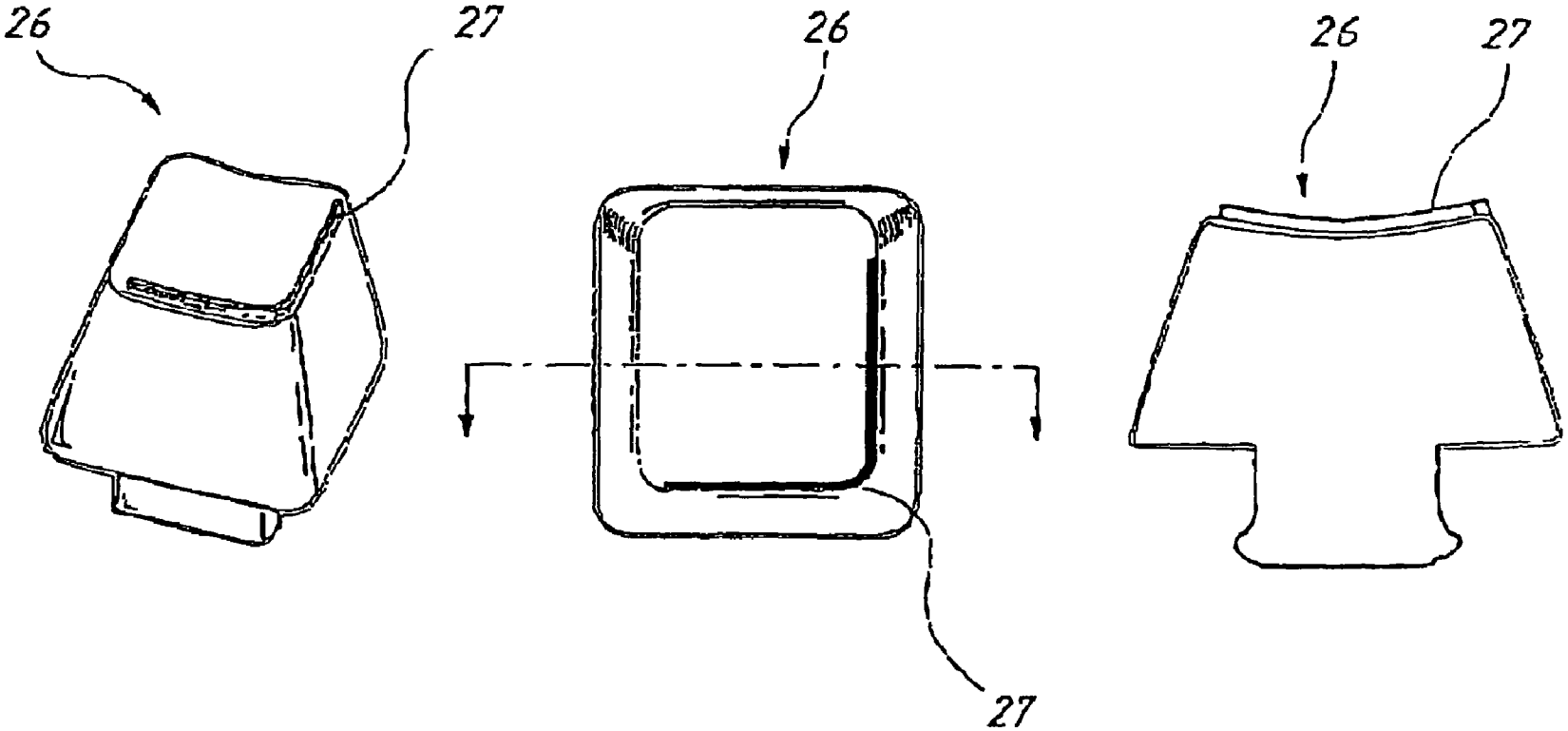
Figure 2D:
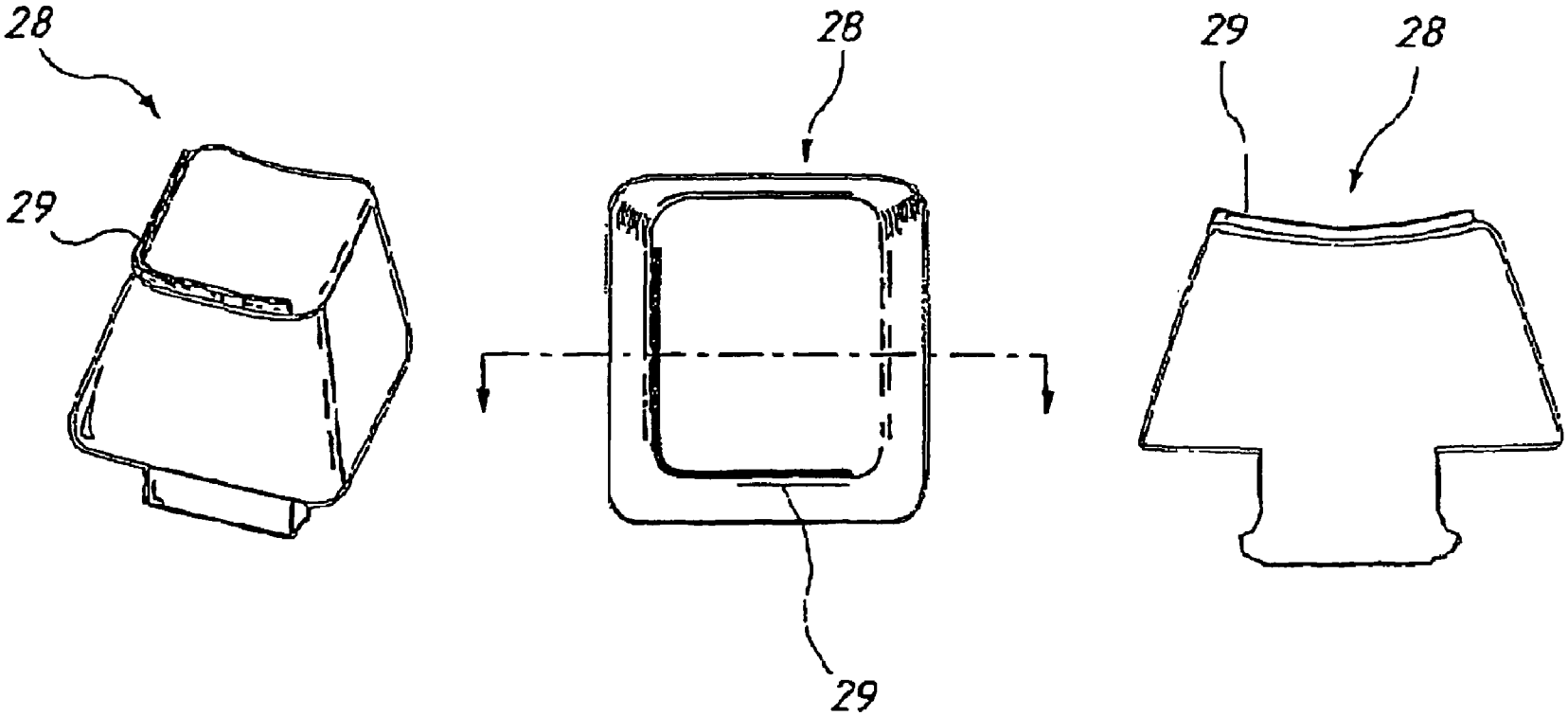

In the embodiment described here, the following keys of the standard QWERTY keyboard have been modified:

1. The key "Q" 21 has a generally "L" shaped ridge 22 applied to the top border and to the left border (FIG. 2A). The ridge 22 is designed so that it will provide the finger with the feedback information that it has reached a specific position on the keyboard 20 namely, the upper left corner of an imaginary rectangular box 23 formed by the keys Q, W, E, R, F, V, C, X, Z, A. It should be noted, however, that the "L" shaped ridge could be formed by two separate ridges, one on the top border and one on the left border.
2. The key "R" 24 has a generally "L" shaped ridge 25 applied to the top border and to the right border (FIG. 2B). The ridge 25 is designed so that it will provide the finger with the feedback information that it has reached a specific position on the keyboard 20 namely, the upper right corner of the same imaginary rectangular box 23 described in 1 above. It should be noted, however, that the "L" shaped ridge could be formed by two separate ridges, one on the top border and one on the right border.
3. The key "V" 26 has a generally "L" shaped ridge 27 applied to the bottom border and to the right border (FIG. 2C). The ridge 27 is designed so that it will provide the finger with the feedback information that it has reached a specific position on the keyboard 20 namely, the lower right corner of the same imaginary rectangular box 23 described in 1 above. It should be noted, however, that the "L" shaped ridge could be formed by two separate ridges, one on the bottom border and one on the right border.
4. The key "Z" 28 has a generally "L" shaped ridge 29 applied to the bottom border and to the left border (FIG. 2D). The ridge 29 is designed so that it will provide the finger with the feedback information that it has reached a specific position on the keyboard 20 namely, the lower left corner of the same imaginary rectangular box 23 described in 1 above. It should be noted, however, that the "L" shaped ridge could be formed by two separate ridges, one on the bottom border and one on the left border.

Figure 2E:
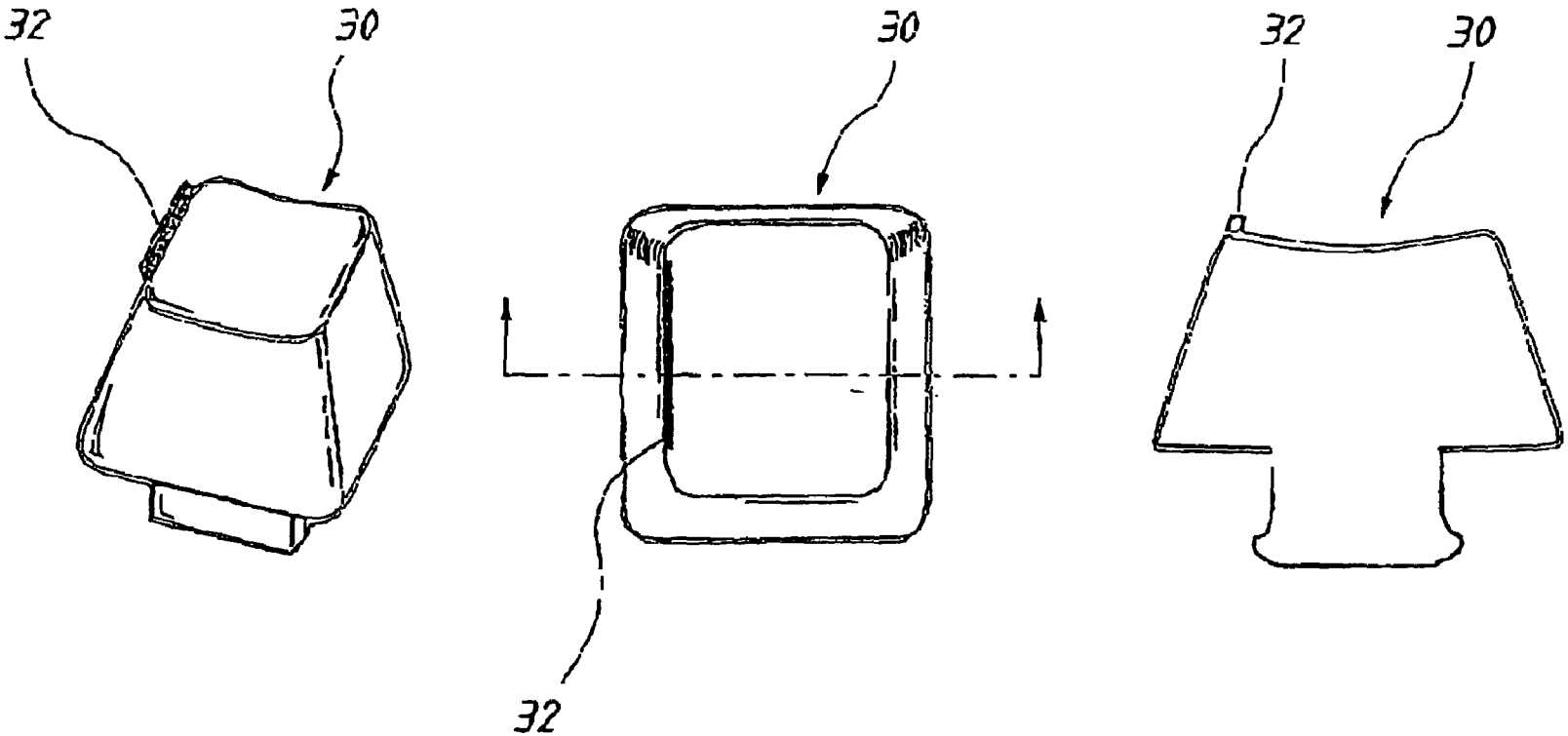
Figure 2F:
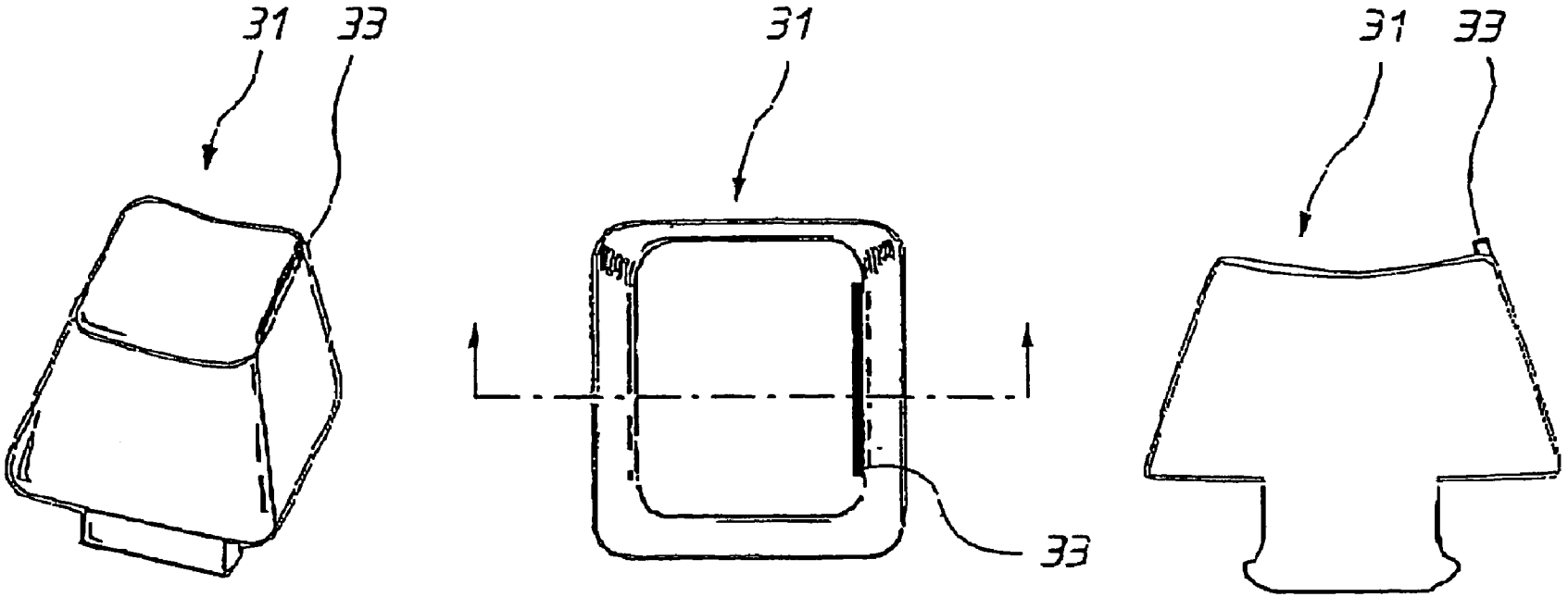

5. The keys "A" 30 and "F" 31 each have one ridge 32, 33 applied to the left border in the case of the key "A" 30 and to the right border in the case of the home key "F" 31 (FIG. 2E and FIG. 2F). These ridges 32, 33 are designed so that they provide the two fingers designated to use these keys with the feedback information that the fingers are in a "middle" row since the feedback is that of a lateral ridge without a corner. In other words, the finger senses that it is not in a "corner" position.
6. The key "U" 34 has a generally "L" shaped ridge applied to the top border and to the left border (similar to as shown in FIG. 2A). The ridge is designed so that it will provide the finger with the feedback information that it has reached a specific position on the keyboard namely, the upper left corner of an imaginary rectangular box 35 formed by the keys U, I, O, P, ;, /, >, <, M, J. It should be noted, however, that the "L" shaped ridge could be formed by two separate ridges, one on the top border and one on the left border.
7. The key "P" 36 has a generally "L" shaped ridge applied to the top border and to the right border (similar to as shown in FIG. 2B). The ridge is designed so that it will provide the finger with the feedback information that it has reached a specific position on the keyboard namely, the upper right corner of the same imaginary rectangular box 35 described in 6 above. It should be noted, however, that the "L" shaped ridge could be formed by two separate ridges, one on the top border and one on the right border.
8. The key "M" 37 has a generally "L" shaped ridge applied to the bottom border and to the left border (similar to as shown in FIG. 2D). The ridge is designed so that it will provide the finger with the feedback information that it has reached a specific position on the keyboard namely, the lower left corner of the same imaginary rectangular box 35 described in 6 above. It should be noted, however, that the "L" shaped ridge could be formed by two separate ridges, one on the bottom border and one on the left border.
9. The key "/" 38 has a generally "L" shaped ridge applied to the bottom border and to the right border (similar to as shown in FIG. 2C). The ridge is designed so that it will provide the finger with the feedback information that it has reached a specific position on the keyboard namely, the lower right corner of the same imaginary rectangular box 35 described in 6 above. It should be noted, however, that the "L" shaped ridge could be formed by two separate ridges, one on the bottom border and one on the right border.
10. The keys "J" 39 and ";" 40 each have one ridge applied to the left border in the case of the home key "J" 39 and to the right border in the case of the key ";" 40 (similar to as shown in FIG. 2E and FIG. 2F). These ridges are designed so that they provide the two fingers designated to use these keys with the feedback information that the fingers are in the middle row of the same imaginary rectangular box 35 described in 6 above.

Figure 2G:
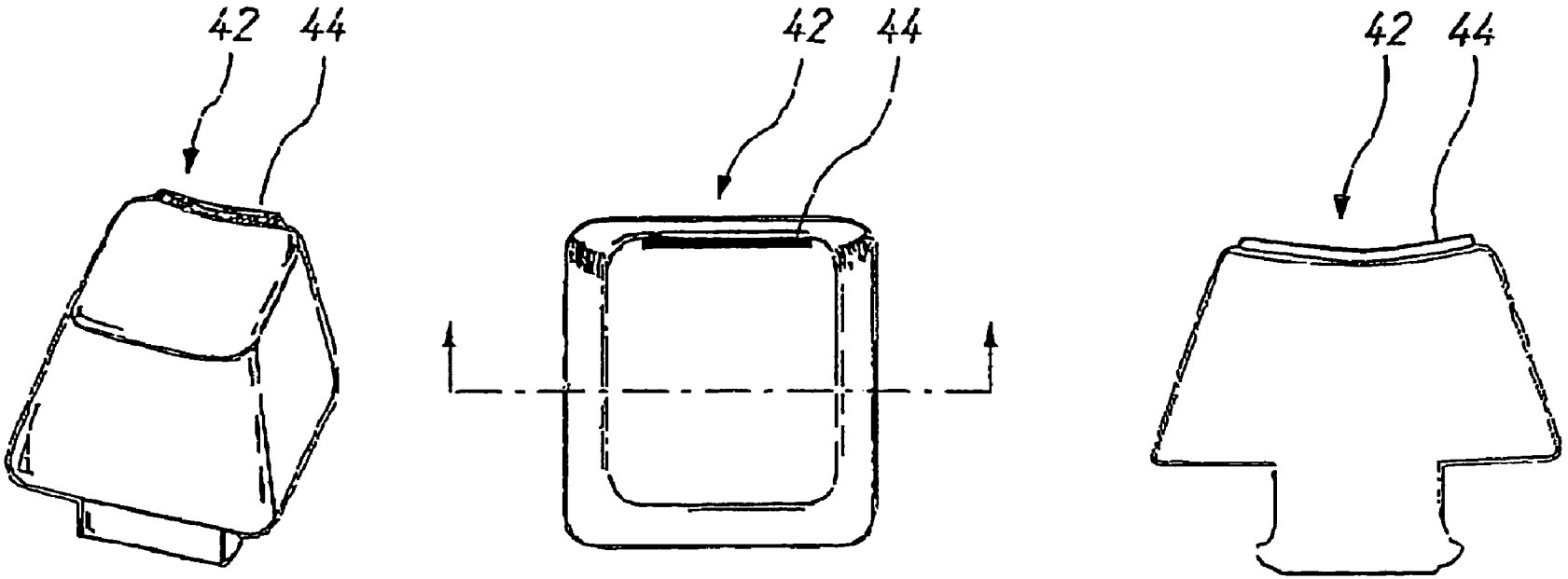
Figure 2H:
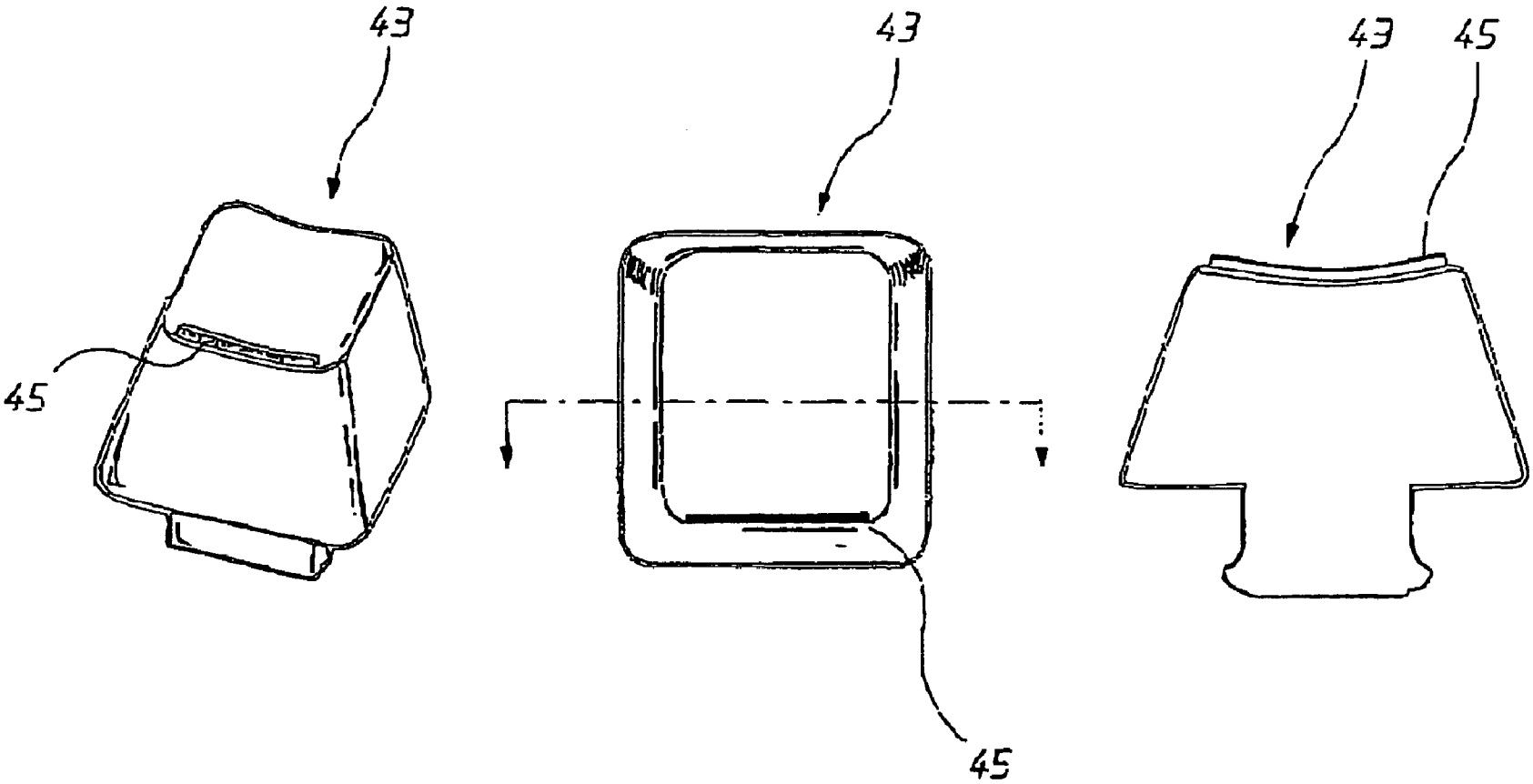

In the same manner the numerical keys of the QWERTY keyboard 10 shown in FIG. 1, have been modified so that they provide the same positive feedback information and the fingers can operate within a "box" 41 formed by "walls" applied to the keys "7""8", "9", "6", "3", "2", "1 and 4". It can be seen that the modifications are identical to those for similarly positioned keys of the alphabetical portion of the keyboard 20, except for keys "8" 42 and "2" 43, thus:

1. The key "7" has a generally "L" shaped ridge applied to the top and to the left border (similar to as shown in FIG. 2A). The ridge is designed so that it will provide the finger with the feedback information that it has reached a specific position on the keyboard 20 namely, the upper left corner of an imaginary rectangular box 41 formed by the keys 7, 8, 9, 6, 3, 2, 1, 4. It should be noted, however, that the "L" shaped ridge could be formed by two separate ridges, one on the top border and one on the left border.
2. The key "9" has a generally "L" shaped ridge applied to the top border and to the right border (similar to as shown in FIG. 2B). The ridge is designed so that it will provide the finger with the feedback information that it has reached a specific position on the keyboard 20 namely, the upper right corner of the same imaginary rectangular box 41 described in 1 above. It should be noted, however, that the "L" shaped ridge could be formed by two separate ridges, one on the top border and one on the right border.
3. The key "3" has a generally "L" shaped ridge applied to the bottom border and to the right border (similar to as shown in FIG. 2C). The ridge is designed so that it will provide the finger with the feedback information that it has reached a specific position on the keyboard 20 namely, the lower right corner of the same imaginary rectangular box 41 described in 1 above. It should be noted, however, that the "L" shaped ridge could be formed by two separate ridges, one on the bottom border and one on the right border.
4. The key "1" has a generally "L" shaped ridge applied to the bottom border and to the left border (similar to as shown in FIG. 2D). The ridge is designed so that it will provide the finger with the feedback information that it has reached a specific position on the keyboard 20 namely, the lower left corner of the same imaginary rectangular box 41 described in 1 above. It should be noted, however, that the "L" shaped ridge could be formed by two separate ridges, one on the bottom border and one on the left border.
5. The key "4" has one ridge applied to the left border (similar to as shown in FIG. 2E) which ridge is designed so that it provides the finger with the feedback information that it has reached a specific position on the keyboard 20 namely, the left middle edge of the same imaginary rectangular box 41 described in 1 above.
6. The key "6" has one ridge applied to the right border (similar to as shown in FIG. 2F) which ridge is designed so that it provides the finger with the feedback information that it has reached a specific position on the keyboard 20 namely, the right middle edge of the same imaginary rectangular box 41 described in 1 above.
7. The key "8" 42 has one ridge 44 applied to the top border (similar to as shown in FIG. 2G) which ridge is designed so that it provides the finger with the feedback information that it has reached a specific position on the keyboard 20 namely, the top middle edge of the same imaginary rectangular box 41 described in 1 above.
8. The key "2" 43 has one ridge 45 applied to the bottom border (similar to as shown in FIG. 2H) which ridge is designed so that it provides the finger with the feedback information that it has reached a specific position on the keyboard 20 namely, the bottom middle edge of the same imaginary rectangular box 41 described in 1 above.

It can be seen that the identical modifications described above can be used if desired to modify the directional keys 46 used to move the cursor around the screen of a computer and which are known as the "inverted T", or similarly the functional keys 47 ("Insert", "Home", "PageUp", "Delete", "End", "PageDown"), to obtain similar locational feel and feedback.

It can also be seen that the modifications described in number 5 and 6 above, can be used, if desired, to modify the keys "1", "4", "7", "0"48 of the row 16 of the QWERTY keyboard 10 of FIG. 1 to obtain similar locational feel and feedback.

Further keys of the QWERTY keyboard or similar keyboards (such as AZERTY, QWERTZ or split keyboards) could be modified in a similar way, such as, for example, that the keys corresponding to "W", "E", "I", "O", all have a ridge applied to the top of the respective key similar to the ridge of the key "8" as described in number 7 above. Similarly, keys "X", "C", "<", ">", could also each respectively have a ridge applied to the bottom of each respective key similar to the ridges of key "2" as described in number 8 above. In this way, a more defined "box" is obtained within which the fingers of the left or right hand are obliged to move.

It can therefore also be seen that a key having a ridge on a border provides a geometric indicator stimulating the user as to the location of the finger within the respective box.

While the above description contains many specificities, these should not be construed as limitations on the scope of the invention, but rather as an exemplification of one preferred embodiment thereof. For example, different keyboards can be similarly modified or new keyboards designed from scratch. Additionally, the "walls" on the keys can be of different height, thickness, shape and appearance such as in FIG. 4 and still activate the feedback which is the subject of this invention. Additionally, this invention may be applied to keyboards or keypads molded to curved surfaces such as the "Microsoft Natural Keyboard", split keyboards, keyboards for non-English countries, and equivalent keyboards or keypads, or using non-alphanumeric keys or designations, chording capabilities, single or multiple-hand designs, or miniaturization. Additionally, the invention may be applied to keypads used on telephones, calculators, cash registers, electrical appliances and other electronic or non-electronic devices such as a typewriter. The ridges on the keys may be integral with the keycap or the ridges can be formed of plastic material with a self-adhesive backing for attachment to keys of a "normal" is keyboard or keypad. Further, the keys could be of any shape, rectangular, round, oval, hexagonal or any other shape.

Although the invention has been described with reference to specific examples, it will be appreciated by those skilled in the art that the invention may be embodied in many other forms.

The claims defining the invention are as follows:

1. A keyboard or keypad including at least three rows of keys including a top row which is remote from the user, a middle row, and a bottom row which is adjacent to the user, each row having at least three keys including a left and a right end key, each key having a finger engaged surface of with a central axis perpendicular to said finger engaged surface, said surface having arcuate top and bottom edge portions extending angularly about said axis and arcuate left and right edge portions also extending angularly about said axis, and wherein the keys include:

(i) a ridge on the top left end key adjacent to the upper edge portion thereof extending generally in the direction of the rows, (ii) a ridge on the top left end key adjacent to the left edge portion thereof extending generally in a direction transverse to the rows, (iii) a ridge on the bottom left end key adjacent to the left edge portion thereof extending generally in a direction to the rows, (iv) a ridge on the bottom left end key adjacent to the bottom edge portion thereof extending generally in the direction of the rows, (v) a ridge on the bottom right end key adjacent to the bottom edge portion thereof extending generally in the direction of the rows, (vi) a ridge on the bottom right end key adjacent to the right edge portion thereof extending generally in the direction transverse to the rows, (vii) a ridge on the top right end key adjacent to the right edge portion thereof extending generally in the direction transverse to the rows, and (viii) a ridge on the top right end key adjacent to the upper edge portion thereof extending generally in the direction of the rows.

2. A QWERTY keyboard having a plurality of alphanumeric keys arranged in three linear rows including a top row which is remote from the user, a middle row, and a bottom row which is adjacent to the user, each row having a left and a right end key, each key having a finger engaged surface with a central axis perpendicular to said finger engaged surface, said surface having arcuate top and bottom edge portions extending angularly about said axis and arcuate left and right side edge portions also extending angularly about said axis, the keys being positioned in a left first set and a right second set, the first set including the three left end keys and at least the next two or three adjacent keys of each row, the second set including the three right end keys and the next adjacent two or three keys spaced toward the first set so that the two sets are spaced by two, three or four keys, and wherein the keys of said first set include:

(i) a ridge on the top left end key adjacent to the upper edge portion thereof extending generally in a direction of the rows, (ii) a ridge on the top left end key adjacent to the left edge portion thereof extending generally in a direction transverse to the rows, (ii) a ridge on the middle left end key adjacent to the left edge portion thereof extending generally in the direction transverse to the rows, (iv) a ridge on the bottom left end key adjacent to the left edge portion thereof extending generally in the direction transverse to the rows, (v) a ridge on the bottom left end key adjacent to the bottom edge portion thereof extending generally in the direction of the rows, (vi) a ridge on the next adjacent or next two adjacent keys to said bottom left end key of the bottom row adjacent to the bottom edge portion thereof extending generally in the direction of the rows, (vii) a ridge on the next adjacent bottom key adjacent to the bottom edge portion thereof extending generally in the direction of the rows, (viii) a ridge on said last mentioned key adjacent to the right edge portion thereof extending generally in the direction transverse to the rows, (ix) a ridge on the middle key next adjacent to said last mentioned key adjacent to the right edge portion thereof extending generally in the direction transverse to the rows, (x) a ridge on the top key next adjacent to said last mentioned key adjacent to the right edge portion thereof extending generally in the direction transverse to the rows, (xi) a ridge on said last mentioned key adjacent to the top edge portion thereof extending generally in the direction of the rows, (xii) a ridge on the or each top key between said last mentioned key and said top left end key adjacent to the top edge portion thereof extending generally in the direction of the rows, and the keys of said second set include:

(i) a ridge on the top right end key adjacent to the upper edge portion thereof extending generally in the direction of the rows, (ii) a ridge on the top right end key adjacent to the right edge portion thereof extending generally in the direction transverse to the rows, (iii) a ridge on the middle key adjacent to said top right key adjacent to the right edge portion thereof extending generally in the direction transverse to the rows, (iv) a ridge on the bottom right end key adjacent to the right edge portion thereof extending generally in the direction transverse to the rows, (v) a ridge on the bottom right end key adjacent to the bottom edge portion thereof extending generally in the direction of the rows, (vi) a ridge on the next adjacent or next two adjacent keys to said bottom right end key of the bottom row adjacent to the bottom edge portion thereof extending generally in the direction of the rows, (vii) a ridge on the next adjacent bottom key adjacent to the bottom edge portion thereof extending generally in the direction of the rows, (viii) a ridge on said last mentioned key adjacent to the left edge portion thereof extending generally in the direction transverse to the rows, (ix) a ridge on the middle key next adjacent to said last mentioned key adjacent to the left edge portion thereof extending generally in the direction transverse to the rows (x) a ridge on the top key next adjacent to said last mentioned key adjacent to the left edge portion thereof extending generally in the direction transverse to the rows, (xi) a ridge on said last mentioned key adjacent to the top edge portion thereof extending generally in the direction of the rows, (xii) a ridge on the or each top key between said last mentioned key and said top right end key adjacent to the top edge portion thereof extending generally in the direction of the rows.

3. The keyboard of claim 1, wherein the finger engaging surface of each key has a round configuration.

4. The keyboard of claim 3, wherein the ridges on the keys are curved.

5. The keyboard of claim 4, wherein the ridges on the top left end key form an arc extending along a top left portion of the key, the ridges on the bottom left end key form an arc extending along a bottom left portion of the key, the ridges on the top right end key form an arc extending along a top right portion of the key, and the ridges on the bottom right end key form an arc extending along a bottom right portion of the key.

6. The keyboard of claim 5, wherein at least one key between the left end and right end keys in the upper row is provided with a ridge of arc shape at a central top portion of the key, and wherein at least one key between the left end and right end keys on the lower row is provided with a ridge of arc shape at a central bottom portion of the key.

7. The keyboard of claim 6, wherein the left end key of the middle row is provided with a ridge of arc shape at a central portion of the left edge of the key, and wherein the right end key of the middle row has a ridge of arc shape at a central portion of the right edge of the key.

8. The QWERTY keyboard of claim 2, wherein the finger engaging surface of each key has a round configuration.

9. The QWERTY keyboard of claim 8, wherein the ridges on the keys are curved.

10. The QWERTY keyboard of claim 9, wherein the ridges on the keys are of arc configuration.

* * * * *